US008411008B2

(12) United States Patent
Song et al.

(10) Patent No.: US 8,411,008 B2
(45) Date of Patent: Apr. 2, 2013

(54) LIQUID CRYSTAL DISPLAY HAVING A PLURALITY OF COMMON VOLTAGES APPLIED DURING DIFFERENT DRIVING TIME AND DRIVING METHOD THEREOF

(75) Inventors: Hwadong Song, Seoul (KR); Younghoon Kim, Incheon (KR)

(73) Assignee: LG Display Co., Ltd., Seoul (KR)

( * ) Notice: Subject to any disclaimer, the term of this patent is extended or adjusted under 35 U.S.C. 154(b) by 663 days.

(21) Appl. No.: 12/314,151

(22) Filed: Dec. 4, 2008

(65) Prior Publication Data

US 2009/0160839 A1 Jun. 25, 2009

(30) Foreign Application Priority Data

Dec. 21, 2007 (KR) ..... 10-2007-0135777

(51) Int. Cl.
*G09G 3/36* (2006.01)
*G09G 5/00* (2006.01)

(52) U.S. Cl. ..... 345/95; 345/211

(58) Field of Classification Search ..... 345/94–95, 345/210–213

See application file for complete search history.

(56) References Cited

U.S. PATENT DOCUMENTS

| | | | | |
|---|---|---|---|---|
| 2002/0140653 | A1* | 10/2002 | Koyama | 345/87 |
| 2003/0164813 | A1* | 9/2003 | Fujii | 345/101 |
| 2004/0041778 | A1* | 3/2004 | Hiraki et al. | 345/100 |
| 2009/0167665 | A1* | 7/2009 | Inoue et al. | 345/94 |
| 2009/0315872 | A1* | 12/2009 | Ikeda et al. | 345/209 |

FOREIGN PATENT DOCUMENTS

| | | |
|---|---|---|
| KR | 2002-0027275 | 4/2002 |
| KR | 2004-0057804 | 7/2004 |
| KR | 2006-0039873 | 5/2006 |
| WO | WO 2007/125738 | * 11/2007 |

* cited by examiner

*Primary Examiner* — Chanh Nguyen
*Assistant Examiner* — Long D Pham
(74) *Attorney, Agent, or Firm* — Morgan, Lewis & Bockius LLP

(57) ABSTRACT

There is provided a liquid crystal display, which prevents a blur on a display image by periodically varying a common voltage of the liquid crystal display panel. The liquid crystal display comprises: a liquid crystal display panel having pixel electrodes for supplying data voltages and a common electrode for supplying a common voltage; a common voltage generator for generating common voltages of different potentials; and a common voltage supply unit for periodically changing the potential of a common voltage supplied to the common electrode by switching the common voltages from the common voltage generator.

8 Claims, 7 Drawing Sheets

LIQUID CRYSTAL DISPLAY HAVING A PLURALITY OF COMMON VOLTAGES APPLIED DURING DIFFERENT DRIVING TIME AND DRIVING METHOD THEREOF

This application claims the benefit of Korean Patent Application No. 10-2007-00135777 field on Dec. 21, 2008, which is hereby incorporated by reference for all purposes as if fully set forth herein.

BACKGROUND OF THE INVENTION

1. Field of the Invention

The present disclosure relates to a liquid crystal display, which prevents a blur on a display image by periodically varying a common voltage of the liquid crystal display panel, and a driving method thereof.

2. Discussion of the Related Art

An active matrix type liquid crystal display device displays moving images using thin film transistors (hereinafter, referred to as "TFTs") as switching elements. In comparison with a cathode ray tube (CRT), the liquid crystal display device can have a smaller size. Thus, the liquid crystal display device is used as displays in portable information devices, office equipment, computers, televisions, etc., and hence is fast replacing the cathode ray tube.

In the liquid crystal display device, a blur may appear on a display image. To test display quality, as shown in FIG. 1, when blocks of black level data and black and white level data of a chessboard test pattern are displayed on a display image for a long time, a blur 20 appears as shown in FIG. 2. It is assumed that such a blur 20 is caused by the phenomenon that, as shown in FIG. 3, when an electric field is applied to a liquid crystal cell due to the dielectric anisotropy of liquid crystal, the ions in the liquid crystal cell are separated in the opposite direction to each other according to the polarity of the electric field. In the liquid crystal cell, ions of different polarities are accumulated in a pixel electrode and a common electrode. When a DC voltage is applied to a liquid crystal layer for a long time, the alignment film is deteriorated as the accumulated amount of the ions increases, and, as a result, the orientation characteristics of the liquid crystal is deteriorated. Due to this, when a DC voltage is applied to the liquid crystal display device for a long time, a blur is generated. To solve the problem of blurring, a method for developing a liquid crystal material having a low dielectric constant or a method for improving an orientation material or orientation method has been attempted. However, there has been another problem that it is not easy to develop materials, and if the dielectric constant of liquid crystal is low, the driving characteristics of the liquid crystal are deteriorated.

The polarity of a data voltage Vdata of liquid crystal cells is varied according to a relative potential difference with a common voltage Vcom as shown in FIG. 4. The common voltage Vcom is generated as a DC voltage. A blur 20 may occur due to electric charges 31 and 32 separated and accumulated according to the polarities of the data voltage Vdata and the common voltage Vcom. Such a blur 20 appears in an irregular pattern even between panels manufactured in the same manufacturing line, thus making it difficult to remove only by improvement of the process.

SUMMARY OF THE INVENTION

The present disclosure has been made in an effort to solve the problems occurring in the related art, and to provide a liquid crystal display, which prevents a blur on a display image by periodically varying a common voltage of the liquid crystal display panel, and a driving method thereof.

To accomplish this advantage, a liquid crystal display according to an embodiment of the present disclosure comprises: a liquid crystal display panel having pixel electrodes for supplying data voltages and a common electrode for supplying a common voltage; a common voltage generator for generating common voltages of different potentials; and a common voltage supply unit for periodically changing the potential of a common voltage supplied to the common electrode by switching the common voltages from the common voltage generator.

A driving method of a liquid crystal display according to an embodiment of the present disclosure comprises: generating common voltages of different potentials; and periodically changing the potential of a common voltage supplied to a common electrode by switching the common voltages from a common voltage generator.

BRIEF DESCRIPTION OF THE DRAWINGS

The accompanying drawings, which are included to provide a further understanding of the disclosure and are incorporated on and constitute a part of this specification illustrate embodiments of the disclosure and together with the description serve to explain the principles of the disclosure.

DETAILED DESCRIPTION OF THE ILLUSTRATED EMBODIMENTS

Hereinafter, exemplary embodiments of the present disclosure will be described with reference to FIGS. 5 to 9.

Figure 1:
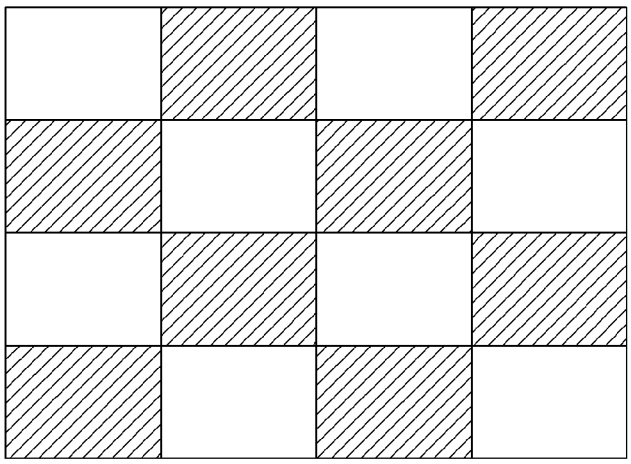
FIG. 1 (RELATED ART)
FIG. 1 is a view showing a chessboard pattern for testing display quality.
Figure 2:
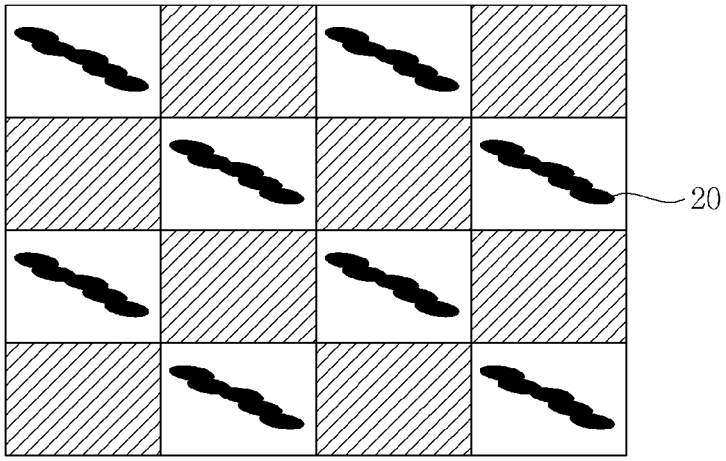
FIG. 2 (RELATED ART)
FIG. 2 is a view depicting one example of a blur seen in the chessboard pattern as shown in FIG. 1.
Figure 3:
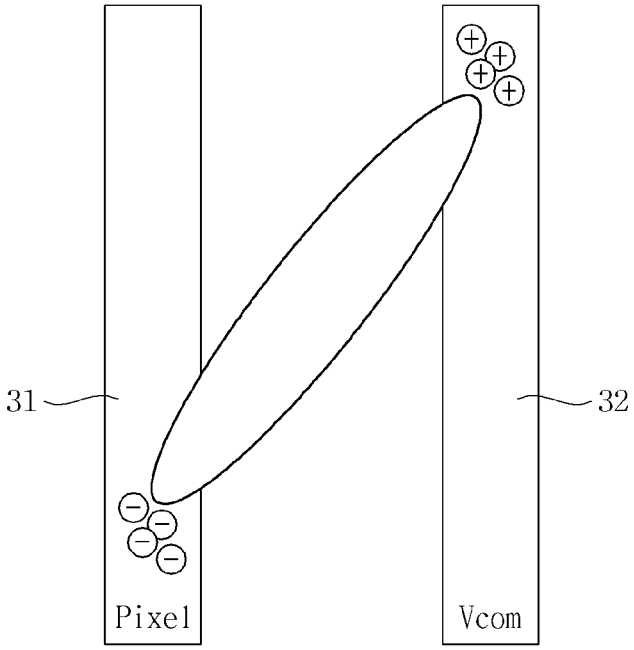
FIG. 3 (RELATED ART)
FIG. 3 is a view showing electric charges accumulated for each polarity in a liquid crystal cell due to the dielectric anisotropy of liquid crystal.
Figure 4:
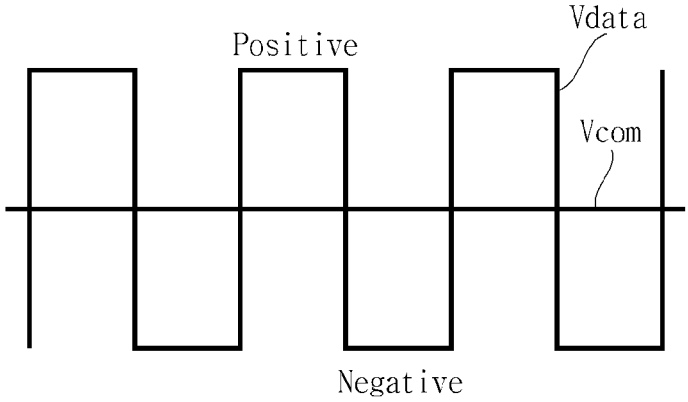
FIG. 4 (RELATED ART)
FIG. 4 is a waveform diagram depicting a conventional common voltage.
Figure 5:
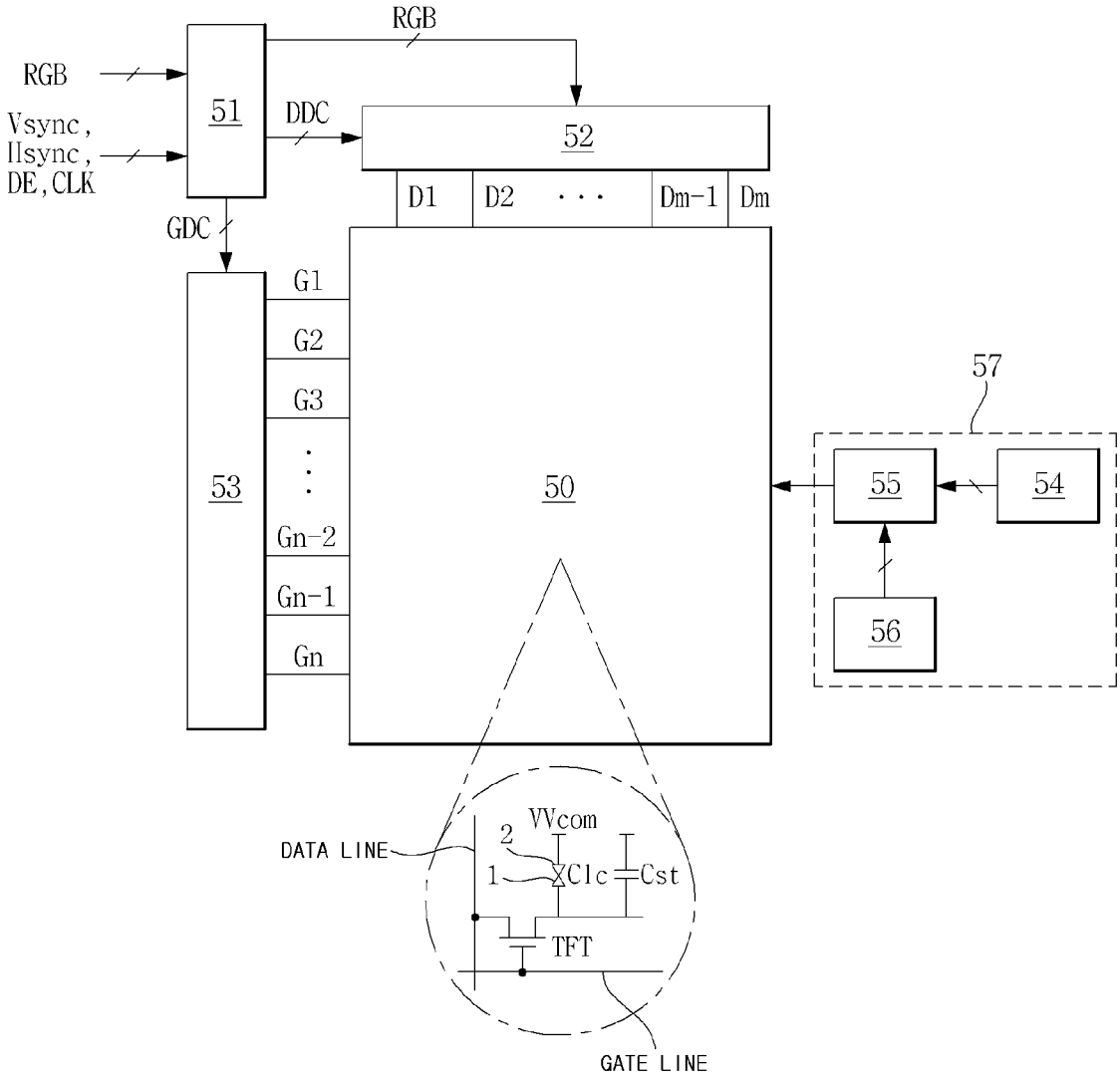
FIG. 5 is a block diagram showing a liquid crystal display according to an embodiment of the present disclosure.

Referring to FIG. 5, a liquid crystal display according to an embodiment of the present disclosure comprises a liquid crystal display panel 50, a timing controller 51, a data drive circuit 52, a gate drive circuit 53, and a common voltage supply unit 57.

In the liquid crystal display panel 50, a liquid crystal layer is formed between two glass substrates. The liquid crystal display panel 50 includes m□n number of liquid crystal cells Clc arranged in a matrix pattern by m-number of data lines D1 to Dm crossing n-number of gate lines G1 to Gn.

Formed on the lower glass substrate of the liquid crystal display panel 50 are data lines D1 to Dm, gate lines G1 to Gn, thin film transistors (TFTs), liquid crystal cells Clc connected to the TFTs and driven by an electric field between pixel electrodes 1 and a common electrode 2, and storage capacitors Cst. Formed on the upper glass substrate of the liquid crystal display panel 50 are a black matrix, color filters, and a common electrode 2. The common electrode 2 is formed on the upper glass substrate in devices employing a vertical electric field driving method, such as a TN (Twisted Nematic) mode or a VA (Vertical Alignment) mode. Alternatively, the common electrode 2 may be formed along with the pixel electrode 1 on the lower glass substrate in devices employing a horizontal electric field driving method, such as an IPS (In-Plane Switching) mode or an FFS (Fringe Field Switching) mode. Polarizers with the optical axes perpendicularly crossing each other are respectively applied to the upper glass substrate and the lower glass substrate of the liquid crystal display panel 50. Alignment films for setting the pre-tilt angle of liquid crystal are then formed in the interfaces of the respective polarizers which face the liquid crystal.

The timing controller 51 receives timing signals such as vertical and horizontal synchronization signals Vsync and Hsync, a data enable signal, and a dot clock (DCLK) signal, to generate timing control signals for controlling the operation timing of the data drive circuit 52 and the gate drive circuit 53. The timing control signals include gate timing control signals, such as a gate start pulse GSP, a gate shift clock signal GSC, and a gate output enable GOE. The gate start pulse GSP indicates a line from which a scan starts so as to generate a first gate pulse. The gate shift clock signal GSC controls the gate drive circuit 53 so as to allow the gate drive circuit 53 to sequentially shift the gate start pulse GSP. The gate output enable signal GOE controls the output of the gate drive circuit 53. The timing control signals include a source start pulse SSP, a source sampling clock SSC, a polarity control signal POL, a source output enable signal SOE, and the like. The source start pulse SSP indicates a start pixel in a first horizontal line in which data are to be displayed. The source sampling clock SSC indicates a latch operation of the data within the data drive circuit 52 on the basis of a rising or falling edge. The polarity control signal POL controls the polarity of an analog video data voltage outputted from the data drive circuit 52. The source output enable signal SOE controls the output of a source drive IC.

The data drive circuit 52 latches the digital video data RGB under control of the timing controller 51, converts the digital video data into an analog positive/negative data voltage, and then supplies the data voltage to the data lines D1 to Dm.

Gate pulses are sequentially supplied to the gate lines G1 to Gn under control of the timing controller 51 of the gate drive circuit 53.

The common voltage supply unit 57 periodically varies the potential of the common voltage VVcom and supplies the common voltage VVcom to the common electrode 2. The periodically varied common voltage VVcom causes a potential variation of the common electrode 2 and distributes the electric charges accumulated on the common electrode 2, thereby preventing excessive electric charges from being accumulated on the common electrode 2.

Figure 6:
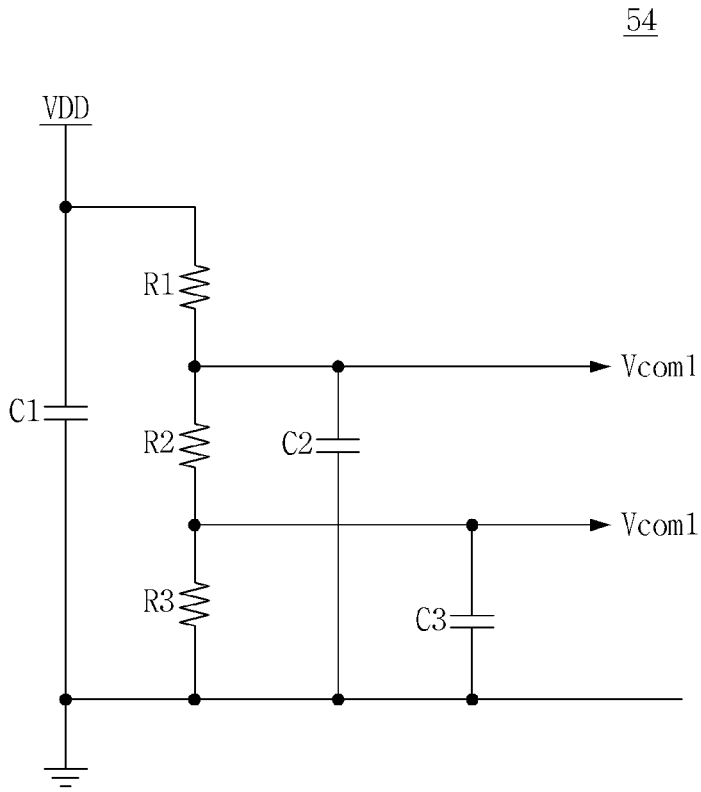
FIG. 6 is a circuit diagram showing in detail the common voltage generator as shown in FIG. 5.

The common voltage supply unit 57 comprises a common voltage generator 54, a switching controller 55, and a timer 56. The common voltage generator 54 generates a plurality of common voltages Vcom1 and Vcom2 whose potentials are different from each other by using voltage-dividing resistance circuits R1 to R3 as shown in FIG. 6 and capacitors C1 to C3 for stabilizing the voltage of each of nodes. A timer 56 counts timing signals, such as vertical and horizontal synchronization signals Vsync and Hsync, a data enable signal and the like inputted form a system board, as a dot clock signal CLK, and supplies a count signal to the switching controller 55. A common voltage variation time is stored in the switching controller 55. The switching controller 55 selects, among the common voltages Vcom1 and Vcom2 supplied from the common voltage generator 54, a common voltage having a normal common voltage potential as a common voltage VVcom to be supplied to the panel, and supplies the voltage to the common electrode 2 for a predetermined period of time. And, when the count signal from the timer 56 indicates a common voltage variation time, the switching controller 55 selects a common voltage having a different potential from the normal common voltage potential and supplies the voltage to the common electrode 2. A common voltage compensation circuit may be installed between the common voltage supply unit 57 and the common electrode 2. The common voltage compensation circuit compensates for a voltage drop of the common voltage occurring according to panel load and driving time, thus reducing the variation width of the common voltage VVcom.

Figure 7:
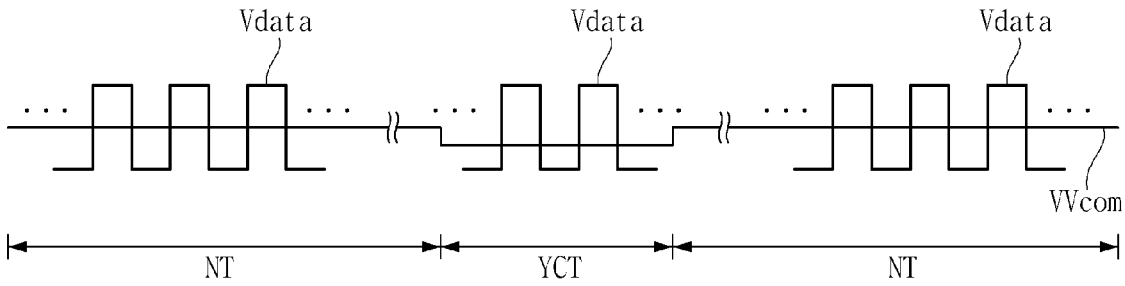
FIG. 7 is a waveform diagram depicting a common voltage according to a first embodiment of the present disclosure.
Figure 8:
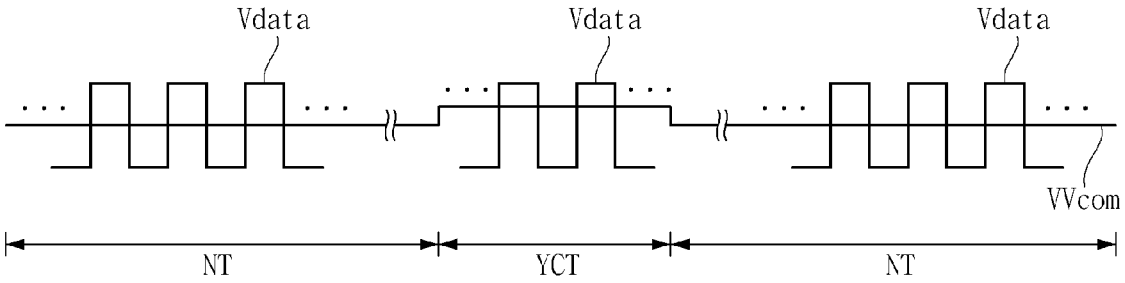
FIG. 8 is a waveform diagram depicting a common voltage according to a second embodiment of the present disclosure.
Figure 9:
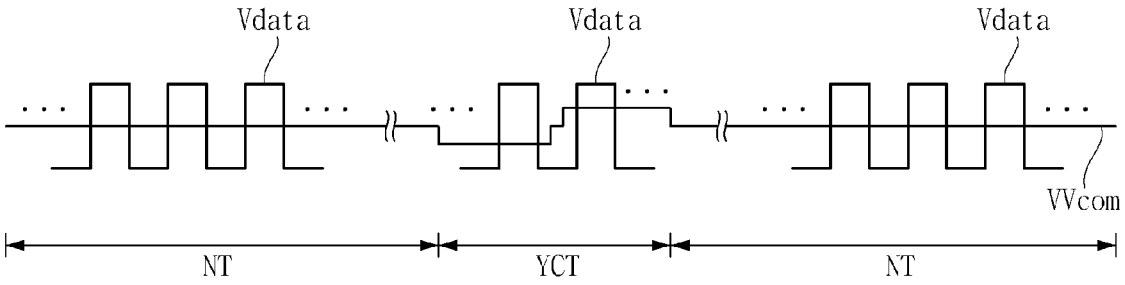
FIG. 9 is a waveform diagram depicting a common voltage according to a third embodiment of the present disclosure.

FIGS. 7 to 9 are waveform diagrams depicting various embodiments of a common voltage generated from the common voltage supply unit 57.

Referring to FIG. 7, the common voltage supply unit 57 supplies a common voltage VVcom having the same potential as the existing common voltage during a normal driving time NT and lowers the potential of the common voltage VVcom during a preset common voltage variation time YCT. The driving time NT and the common voltage variation time YCT are determined based on a time when a blur starts to be seen with naked eyes by continuously applying test data to the liquid crystal display, and are varied according to the driving characteristics of the liquid crystal display panel. Thus, they are experimentally determined for each model. According to experimental data, it is found that a blur appears when several tens of hours of the driving time of the liquid crystal display have passed, and the blur disappears when the potential of the common voltage VVcom is lowered for several minutes to several hours in the event of blurring. The normal driving time NT may be set to a period of time not long enough for blurring, for example, several tens of hours, that is, 20~24 hours, and the common voltage variation time YCT may be set to a short period of time ranging from several minutes to several hours. The common voltage VVcom applied to the common electrode 2 maintains a normal potential for several tens of hours, and thereafter the potential is lowered at a specific point of time, the lowered potential is maintained for a predetermined period of time, and then changed again to the normal potential. The common voltage VVcom applied to the common electrode 2 during the common voltage variation time YCT induces a change of an electric field applied between the common electrode 2 and the pixel electrodes 1, thereby distributing the electric charges separated and accumulated for polarity in the liquid crystal cells Clc.

During the common voltage variation time YCT, when the potential of the common voltage Vcom is lowered, a potential difference between a positive data voltage +Vdata and the common voltage VVcom becomes larger than that during the normal driving time, while a potential difference between a negative data voltage −Vdata and the common voltage VVcom becomes smaller than that during the normal driving time. Therefore, the average gray level of liquid crystal cells expressed over two frame periods is not quite different from that during the normal driving time, and hence there is almost no deterioration of display quality.

Referring to FIG. 8, the common voltage supply unit 57 supplies a common voltage VVcom having the same potential as the existing common voltage during a normal driving time NT and raises the potential of the common voltage VVcom during a preset common voltage variation time YCT. The normal driving time NT may be set to a period of time not long enough for blurring, for example, several tens of hours, that is, 20~24 hours, and the common voltage variation time YCT may be set to a short period of time ranging from several minutes to several hours. The common voltage VVcom applied to the common electrode 2 maintains a normal potential for several tens of hours, and thereafter the potential is raised at a specific point of time, the raised potential is maintained for a predetermined period of time, and then changed again to the normal potential. The common voltage VVcom applied to the common electrode 2 during the common voltage variation time YCT induces a change of an electric field applied between the common electrode 2 and the pixel electrodes 1, thereby distributing the electric charges separated and accumulated for polarity in the liquid crystal cells Clc.

During the common voltage variation time YCT, when the potential of the common voltage Vcom is raised, a potential difference between a positive data voltage +Vdata and the common voltage VVcom becomes smaller than that during the normal driving time, while a potential difference between a negative data voltage −Vdata and the common voltage VVcom becomes larger than that during the normal driving time. Therefore, the average gray level of liquid crystal cells expressed over two frame periods is not quite different from that during the normal driving time, and hence there is almost no deterioration of display quality.

Referring to FIG. 9, the common voltage supply unit 57 supplies a common voltage VVcom having the same potential as the existing common voltage during a normal driving time NT and changes the potential of the common voltage VVcom more than one time during a preset common voltage variation time YCT. The normal driving time NT may be set to a period of time not long enough for blurring, for example, several tens of hours, that is, 20~24 hours, and the common voltage variation time YCT may be set to a short period of time ranging from several minutes to several hours. The common voltage VVcom applied to the common electrode 2 maintains a normal potential for several tens of hours, and thereafter the potential becomes lower than the normal potential within the common voltage variation time YCT and, after the passage of a predetermined time, becomes higher than the normal potential. And, subsequent to the common voltage variation time YCT, when the normal driving time NT starts, the common voltage VVcom is changed again to the normal potential. The common voltage VVcom applied to the common electrode 2 during the common voltage variation time YCT induces a change of an electric field applied between the common electrode 2 and the pixel electrodes 1, thereby distributing the electric charges separated and accumulated for polarity in the liquid crystal cells Clc.

As described in FIGS. 7 and 8, even if the potential of the common voltage Vcom is changed during the common voltage variation time YCT, the average gray level of two frame periods is not quite different from that during the normal driving time, and hence there is almost no deterioration of display quality.

As described in detail above, the liquid crystal display and driving method thereof according to the embodiments of the present disclosure can prevent a blur on a display image by periodically varying the potential of a common electrode and distributing electric charges separated and accumulated for each polarity in a liquid crystal cell.

It will be understood from the description of the present disclosure constructed as above that those skilled in the art can make various modifications and changes without departing from the technical spirit of the present disclosure. Therefore, the scope of the present disclosure is not limited to the detailed description of the present disclosure but should be construed as being defined by the appended claims.

What is claimed is:

1. A liquid crystal display, comprising:

a liquid crystal display panel having pixel electrodes for supplying data voltages and a common electrode for supplying a common voltage;

a common voltage generator for generating common voltages of different potentials; and a common voltage supply unit for periodically changing the potential of a common voltage supplied to the common electrode by switching the common voltages from the common voltage generator, wherein a period of the switching the common voltages includes a variation time and a normal driving time that is greater than the variation time, wherein the normal driving time is set to a period of several tens of hours, wherein the variation time is set to a period of several minutes to several hours, wherein the common voltage supply unit selects any one of the common voltages from the common voltage generator to maintain the potential of the common voltage at a reference potential during the normal driving time, and selects another voltage among the common voltages from the common voltage generator to vary the common voltage to more than two different potentials during the variation time allocated between normal driving times, and wherein the common voltage supply unit comprises:

a counter for counting an input timing signal and detecting a potential variation time point of the common voltage, and a switching controller for switching the common voltages based on an output signal of the counter.

2. The liquid crystal display of claim 1, wherein the potential of the common voltage applied to the common electrode during the variation time is lower than the reference potential.

3. The liquid crystal display of claim 1, wherein the potential of the common voltage applied to the common electrode during the variation time is higher than the reference potential.

4. The liquid crystal display of claim 1, wherein the variation time comprises:

a first variation time during which the potential of the common voltage applied to the common electrode becomes lower than the reference potential; and a second variation time during which the potential of the common voltage applied to the common electrode becomes higher than the reference potential.

5. A driving method of a liquid crystal display having a liquid crystal display panel having pixel electrodes for supplying data voltages and a common electrode for supplying a common voltage, the method comprising:

generating common voltages of different potentials;

periodically changing the potential of a common voltage supplied to a common electrode by switching the common voltages from a common voltage generator;

counting an input timing signal and detecting a potential variation time point of the common voltage; and switching the common voltages based on an output signal of the counting, wherein a period of the switching the common voltages includes a variation time and a normal driving time that is greater than the variation time, wherein the normal driving time is set to a period of several tens of hours, wherein the variation time is set to a period of several minutes to several hours and wherein the periodical changing of the potential of a common voltage comprises:

selecting any one of the common voltages to maintain the potential of the common voltage at a reference potential during the normal driving time, and selecting another voltage among the common voltages to vary the common voltage to more than two different potentials during the variation time allocated between normal driving times.

6. The method of claim 5, wherein the potential of the common voltage applied to the common voltage during the variation time is lower than the reference potential.

7. The method of claim 5, wherein the potential of the common voltage applied to the common electrode during the variation time is higher than the reference potential.

8. The method of claim 5, wherein the variation time comprises:

a first variation time during which the potential of the common voltage applied to the common electrode becomes lower than the reference potential; and a second variation time during which the potential of the common voltage applied to the common electrode becomes higher than the reference potential.

* * * * *